US008967710B2

(12) United States Patent
Hu et al.

(10) Patent No.: US 8,967,710 B2
(45) Date of Patent: Mar. 3, 2015

(54) HIGH CHAIR

(71) Applicants: Wen-Qu Hu, Guangdong (CN); Shun-Min Chen, Taipei (TW)

(72) Inventors: Wen-Qu Hu, Guangdong (CN); Shun-Min Chen, Taipei (TW)

(73) Assignee: Wonderland Nurserygoods Co., Ltd., Neihu, Taipei (TW)

( * ) Notice: Subject to any disclaimer, the term of this patent is extended or adjusted under 35 U.S.C. 154(b) by 0 days.

(21) Appl. No.: 13/845,124

(22) Filed: Mar. 18, 2013

(65) Prior Publication Data

US 2013/0214564 A1 Aug. 22, 2013

Related U.S. Application Data

(63) Continuation of application No. 12/416,937, filed on Apr. 2, 2009, now Pat. No. 8,419,121.

(60) Provisional application No. 61/041,922, filed on Apr. 3, 2008.

(30) Foreign Application Priority Data

Feb. 27, 2009 (CN) ..... 2009 1 0006792

(51) Int. Cl.

| | |
|---|---|
| ***A47C 1/02*** | (2006.01) |
| ***A47D 1/02*** | (2006.01) |
| ***A47D 1/00*** | (2006.01) |

(52) U.S. Cl.

CPC . *A47D 1/02* (2013.01); *A47D 1/002* (2013.01)
USPC ..... 297/55; 403/93; 403/96; 403/98

(58) Field of Classification Search

USPC ..... 297/16.1, 55, 58; 403/84–87, 91–96, 403/98–103

See application file for complete search history.

(56) References Cited

U.S. PATENT DOCUMENTS

| | | | | |
|---|---|---|---|---|
| 4,044,931 | A * | 8/1977 | Catelli | 224/155 |
| 4,441,757 | A * | 4/1984 | Gasca Burges | 297/55 |
| 5,609,390 | A * | 3/1997 | Takafuji | 297/55 |
| 7,156,405 | B1 * | 1/2007 | Ming | 280/87.05 |
| 8,360,514 | B2 * | 1/2013 | Chen et al. | 297/16.1 |
| 2006/0071451 | A1 * | 4/2006 | Cheng | 280/642 |

* cited by examiner

*Primary Examiner* — David E Allred
(74) *Attorney, Agent, or Firm* — Winston Hsu; Scott Margo

(57) ABSTRACT

A folding device is configured at the pivot between the rear leg frame and the front leg frame of a high chair and allows a user to complete folding process by pressing a driving member. When the driving member is pressed, an engaging member of the folding device moves correspondingly to an unlocked position, so that the rear leg frame disengages from and pivots about the front leg frame. The high chair can then be folded easily for the user, and the structure of the invention is simpler than the prior art.

17 Claims, 16 Drawing Sheets

HIGH CHAIR

CROSS REFERENCE TO RELATED APPLICATIONS

This is a continuation application of application Ser. No. 12/416,937, filed Apr. 2, 2009, which claims the benefit of U.S. Provisional Application No. 61/041,922, filed on Apr. 3, 2008, the contents of which are incorporated herein by reference.

BACKGROUND OF THE INVENTION

1. Field of the Invention

The present invention relates to a high chair, and more particularly, to a high chair including a frame body using simplified mechanism and easy to use.

2. Description of the Prior Art

High chairs designed for babies or toddlers have brought great convenience to care givers. With their designed height, babies sitting in seats are tall enough for a sitting care giver to feed them or have interaction. Most conventional high chairs are foldable, which is done by folding the frame body of the high chairs to a smaller size.

In order to fold the high chairs, many ways have been disclosed in the prior art skills, by the ways of assembling the front leg frame and the rear leg frame, and unlocking the two leg frames so that they can move to each other. For example, the U.S. Pat. Nos. 6,126,236 and 5,104,180 add a transverse supportive frame between the front leg frame and the rear leg frame in the high chair. The supportive frame, with fixed length, fixes to the front leg frame and the rear leg frame and maintains the relative position between the front leg frame and the rear leg frame in an engaged status. With different mechanism provided by each patent, users can operate an engagement device at the supportive frame and the front leg frame (or the rear leg frame) to stop the engagement of the supportive frame on the front leg frame (or the rear leg frame). The two leg frames of the high chair can then be folded. A foldable supportive frame linking between the bottoms of the front leg frame and the rear leg frame is disclosed in the U.S. Pat. No. 5,707,104. In the opening status of the high chair, the supportive frame can not be folded and the front leg frame and the rear leg frame can be maintained in the opening status. The user can step on an actuator of the supportive frame on the rear leg frame to fold the supportive frame, and further fold the front and rear leg frames.

The conventional high chairs mentioned above and in the prior art, however, needs an additional supportive frame or pipe transversely configured between the front leg frame and the rear leg frame, and requires direct operation on a folding device at the supportive frame/pipe to fold the high chair. The conventional mechanisms are complicated to be used and difficult to be stored.

SUMMARY OF THE INVENTION

According to the present invention, a high chair includes a seat and a frame body. The frame body supports the seat and is capable of moving between an opened position and a folding position. The frame body includes a front leg frame and a rear leg frame pivotally connected to each other. The frame body further includes a folding body and an engaging member. The folding body is mounted on the front leg frame between longitudinal ends of the front leg frame and the folding body has an arm extending at an angle relative to the front leg frame. The arm is pivotally connected to a pivoting section of the rear leg frame. The engaging member is movably configured on one of the arm of the folding body and the pivoting section of the rear leg frame and engaged with the other one of the arm of the folding body and the pivoting section of the rear leg frame, so as to restrain the frame body in the opened position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
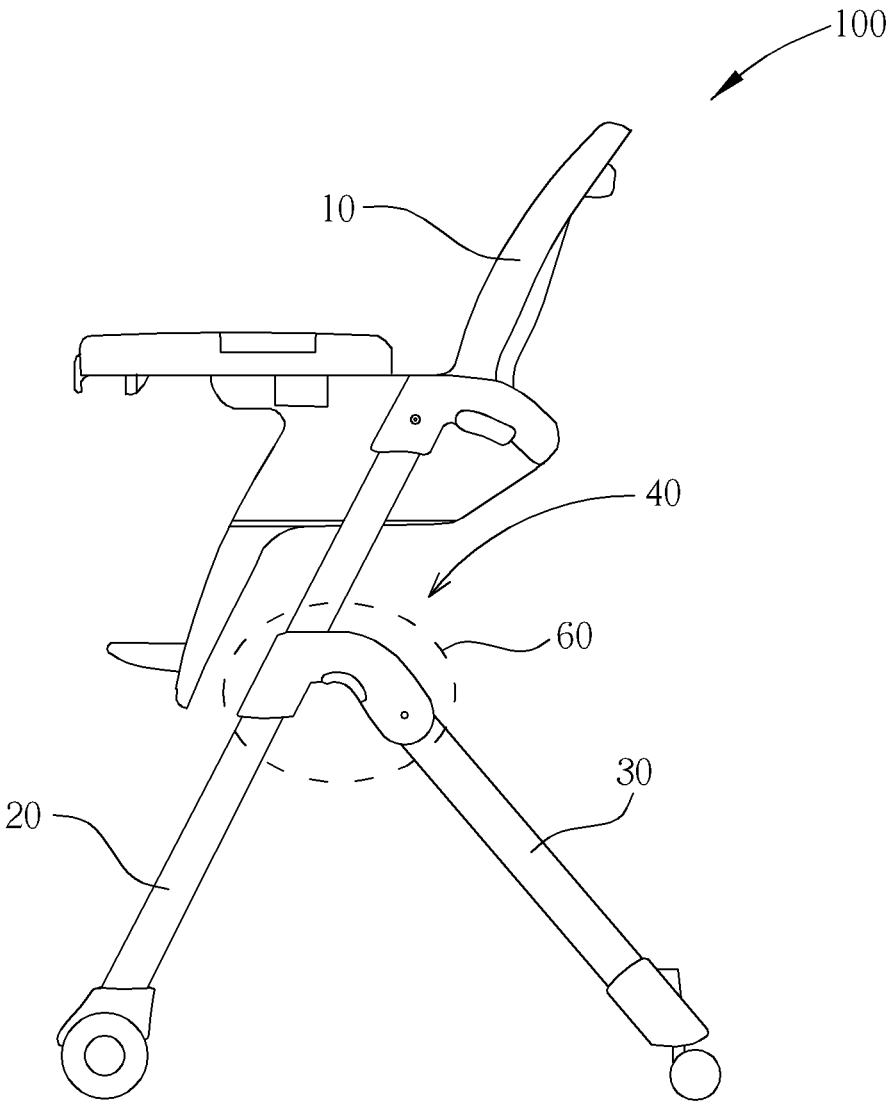
FIG. 1 is a diagram of a high chair in an opened position of the present invention.
Figure 2:
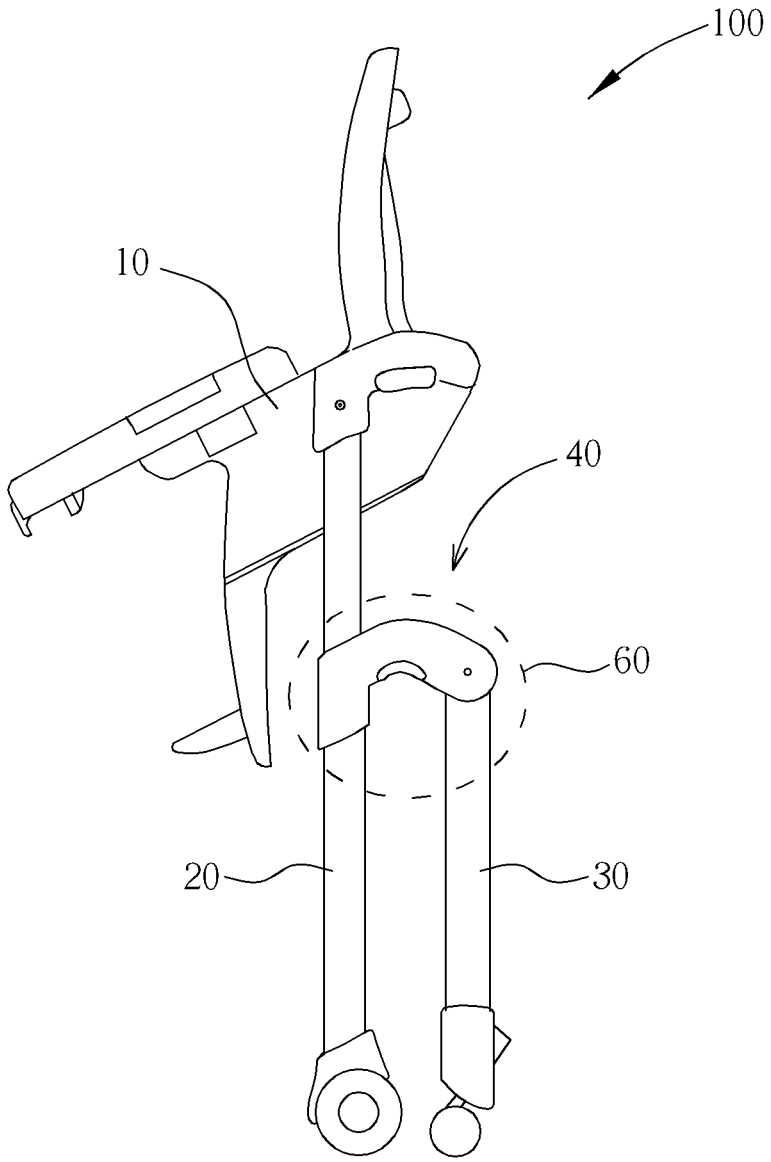
FIG. 2 is a diagram of the high chair in a folding position of the present invention.

Please refer to FIG. 1 and FIG. 2. FIG. 1 is a diagram of a high chair 100 in an opened position of the present invention. FIG. 2 is a diagram of the high chair 100 in a folding position of the present invention. The high chair 100 includes a frame body 40 composed of a front leg frame 20 and a rear leg frame 30, a folding device 60 mounted on a pivot where the front leg frame 20 and the rear leg frame 30 are pivotally connected to each other (Please refer to FIG. 4), and a seat 10 supported by the frame body 40.

Figure 3:
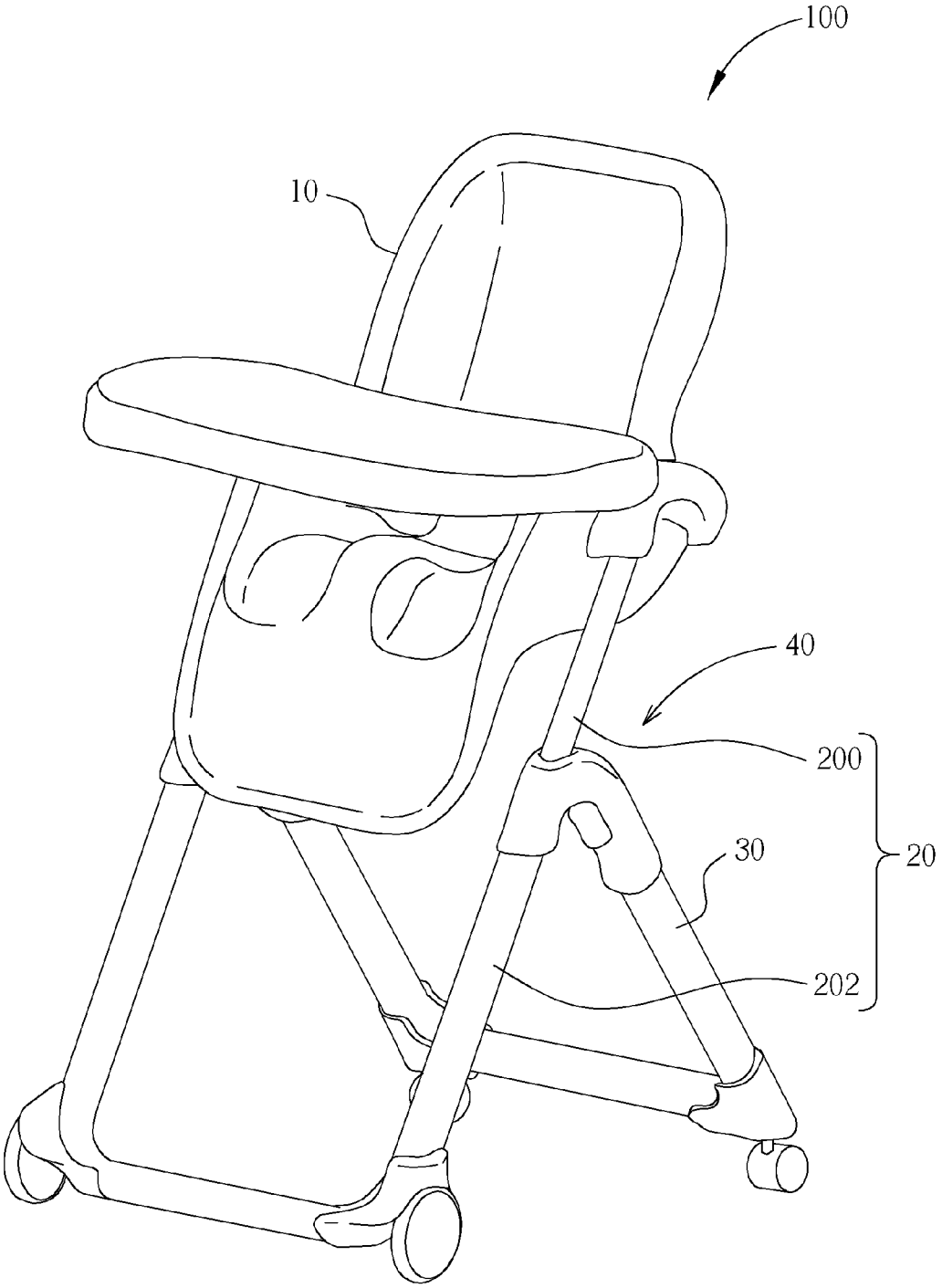
FIG. 3 is a stereoscopic diagram of the high chair of the present invention.

Please refer to FIG. 3. FIG. 3 is a stereoscopic diagram of the high chair 100 of the present invention. The rear leg frame 30 is pivotally connected to a middle of the front leg frame 20. The front leg frame 20 includes an upper front leg 200 and a lower front leg 202. The seat 10 is installed on the upper front leg 200 which can move relative to the lower front leg 202 for adjusting the height of the seat 10. The rear leg frame 30 is pivotally connected to a top end of the lower front leg 202.

When the high chair 100 is in the opened position, a baby can sit in the seat 10, with an adjustable height for a care giver to take care of the baby sitting in the seat 10. The seat 10 can be fixed on the frame body 40, or can be detached from the frame body 40 for storage or other application. The lower front leg 202 of the front leg frame 20 of the frame body 40 and the rear leg frame 30 are U-shaped structure in this embodiment (For example, FIG. 3 shows the U-shaped structure of the lower front leg 202 of the front leg frame 20 and the rear leg frame 30).

The front leg frame 20 and the rear leg frame 30 of the frame body 40 are pivotally connected to each other. The folding device 60 is mounted on the pivot where the rear leg frame 30 is pivotally connected to the front leg frame 20. The frame body 40 can move between the opened position shown in FIG. 1 and the folding position shown in FIG. 2 with the folding device 60. In the opened position, foot ends of the rear leg frame 30 and the front leg frame 20 are fixed and far away to each other. In the folding position, the front leg frame 20 and the rear leg frame 30 can be pivoted and close to each other. The high chair 100 can be folded to a smaller size for storage when the front leg frame 20 and rear leg frame 30 are pivoted to the folding position.

Figure 4:
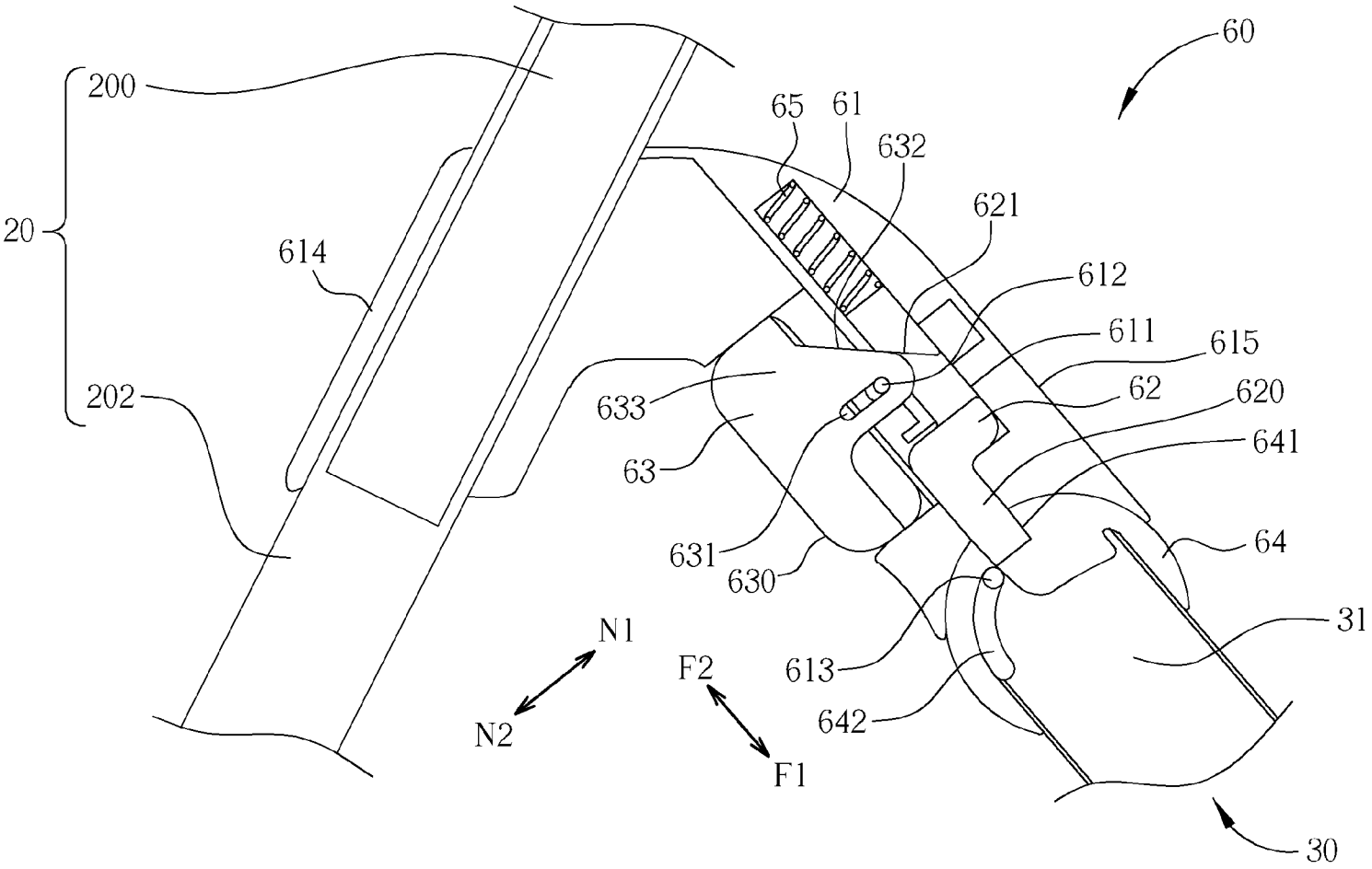
FIG. 4 is a diagram of a folding device according to a first embodiment of the present invention.
Figure 5:
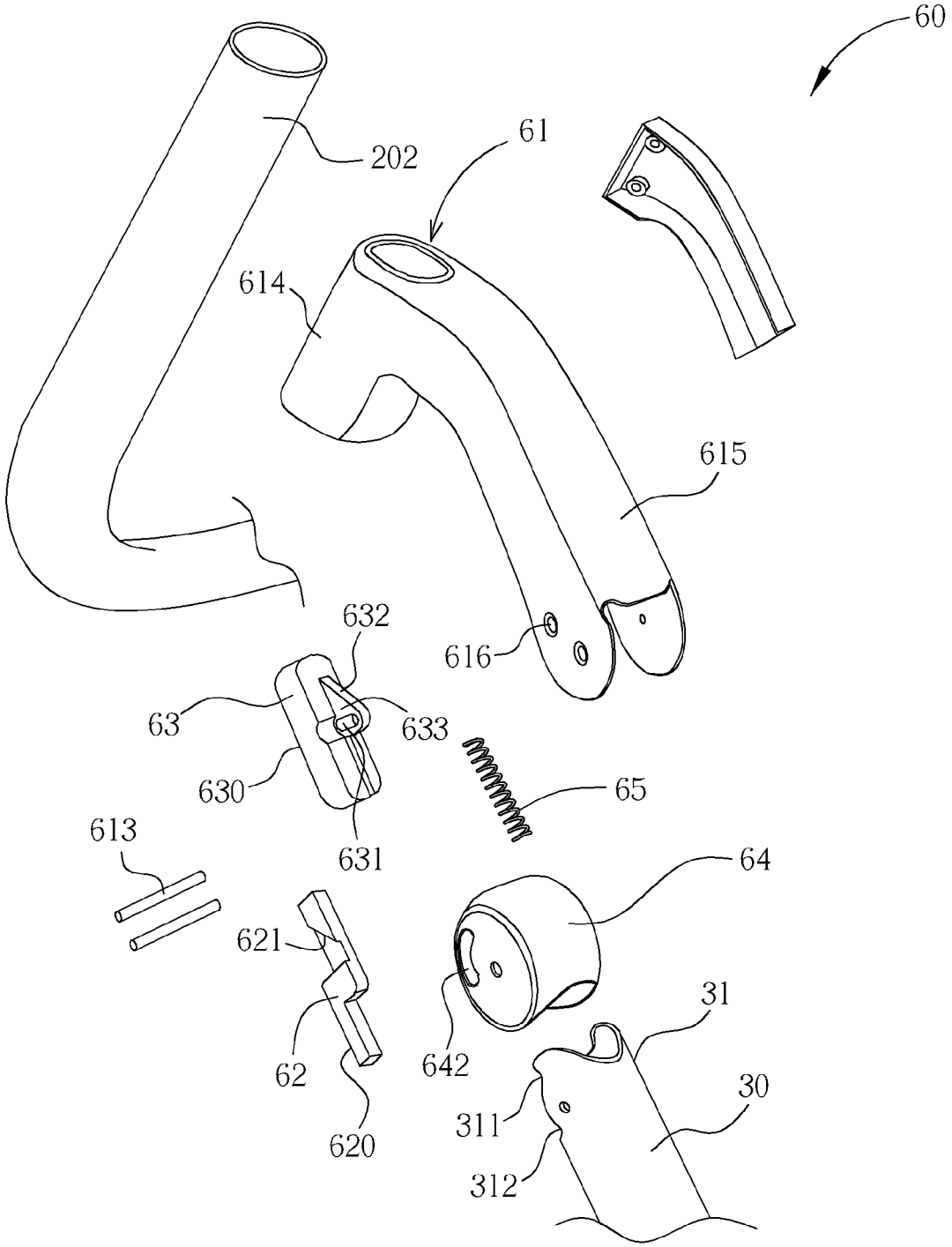
FIG. 5 is an exploded diagram of elements of the folding device according to the first embodiment of the present invention.

Please refer to FIG. 4 and FIG. 5. FIG. 4 is a diagram of the folding device 60 according to a first embodiment of the present invention. FIG. 5 is an exploded diagram of elements of the folding device 60 according to the first embodiment of the present invention. As shown in FIG. 4, when the folding device 60 is in a locked position, the rear leg frame 30 can not be pivoted relative to the front leg frame 20 so as to restrain the frame body 40 in the opened position. The folding device 60 includes a folding body 61, an engaging member 62, a driving member 63, a spindle 64, and an elastic element 65.

As shown in FIG. 4 and FIG. 5, the folding body 61 includes a first arm 614 and a second arm 615 connected to the first arm 614 with an angle. In this embodiment, the first arm 614 shorter than the second arm 615 is configured on a top end of the lower front leg 202 of the front leg frame 20. The spindle 64 is connected to a pivoting section 31 of the rear leg frame 30, and further pivotally connected to the second arm 615 of the folding body 61. Therefore, the spindle 64 and the rear leg frame 30 can be pivoted relative to the folding body 61 (and the front leg frame 20 where the folding body 61 is located). The second arm 615 of the folding body 61 includes a sliding slot 611 extending along direction F1-F2 in this embodiment. The engaging member 62 is slidably configured on the sliding slot 611 and can be moved along directions F1 or F2 between the locked position shown in FIG. 4 and an unlocked position shown in FIG. 6. The engaging member 62 includes an engaging section 620 and a second inclined surface 621 located on the engaging section 620. The elastic element 65 can be a spring. In this embodiment, the elastic element 65 is configured in the sliding slot 611 and connected between the engaging member 62 and the folding body 61. When the engaging member 62 moves in the sliding slot 611, the elastic element 65 is compressed and bears elastic stress. The driving member 63 can be a button. In this embodiment, the driving member 63 includes a pressing portion 630 and a triangular driving portion 633 transversely stretching from the pressing portion 630. The pressing portion 630 can protrude from an opening of the folding body 61 for operation. The driving portion 633 includes a first inclined surface 632 corresponding to the second inclined surface 621 of the engaging member 62 and a long slot 631. The folding body 61 includes an axle 612 passing through the long slot 631 so that the driving member 63 is configured on the folding body 61 in a manner of moving along directions N1 or N2 relative to the folding body 61. Direction N1-N2 and direction F1-F2 are perpendicular to each other in this embodiment.

As shown is FIG. 4, the spindle 64 includes a slot 641 in this embodiment. When the engaging member 62 of the folding device 60 is in the locked position, the engaging section 620 of the engaging member 62 stretches out of the sliding slot 611 of the folding body 61 and into the slot 641 of the spindle 64. At this position, the engaging member 62 abuts on two lateral walls of the slot 641 and the first inclined surface 632 of the driving portion 633 abuts on the second inclined surface 621 of the engaging member 62, so that the spindle 64 and the rear leg frame 30 can not be pivoted relative to the folding body 61 and the front leg frame 20 so that the frame body 40 can be restrained in the opened position.

Figure 6:
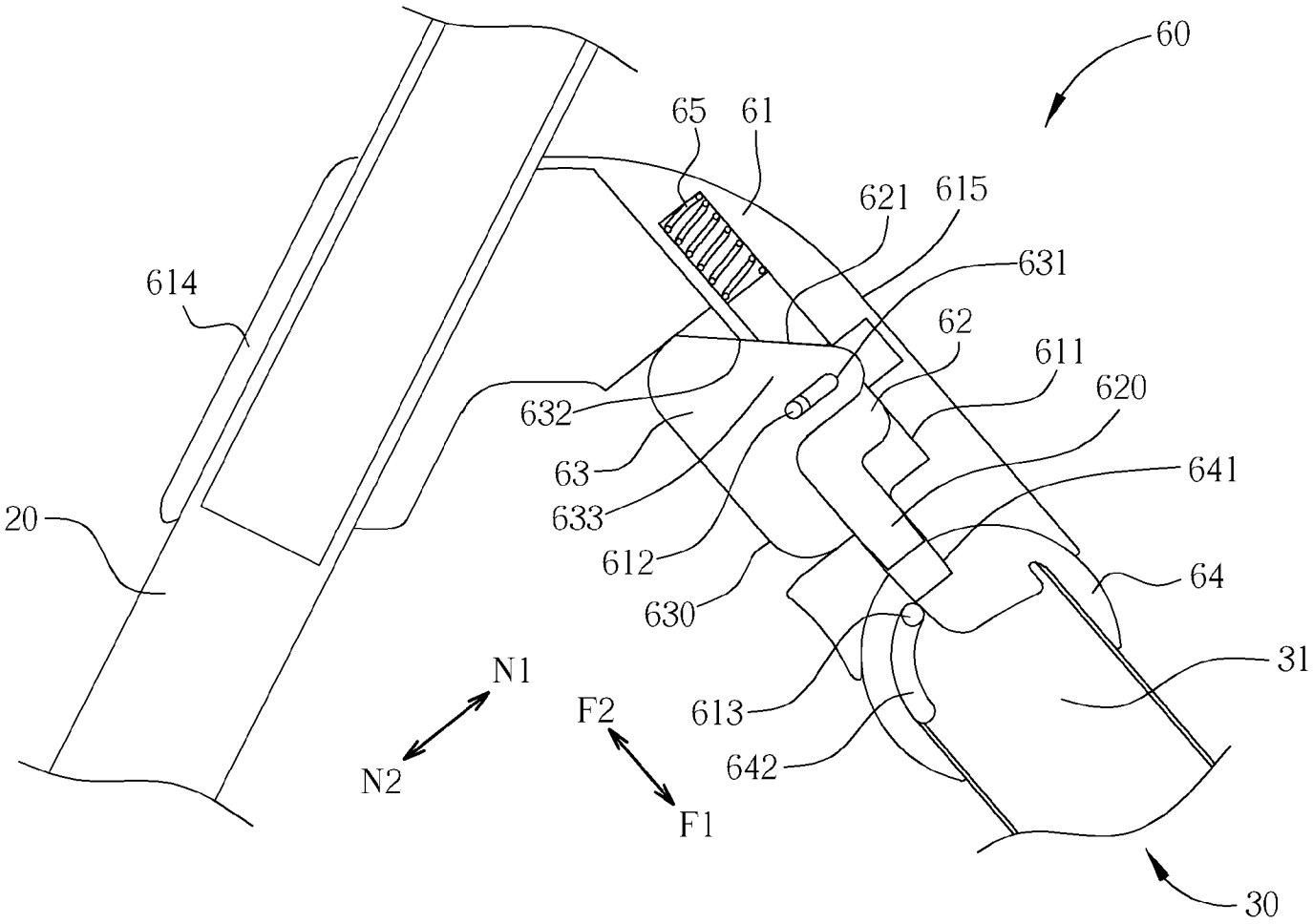
FIG. 6 is a diagram of the folding device in an unlocked position according to the first embodiment of the present invention.
Figure 7:
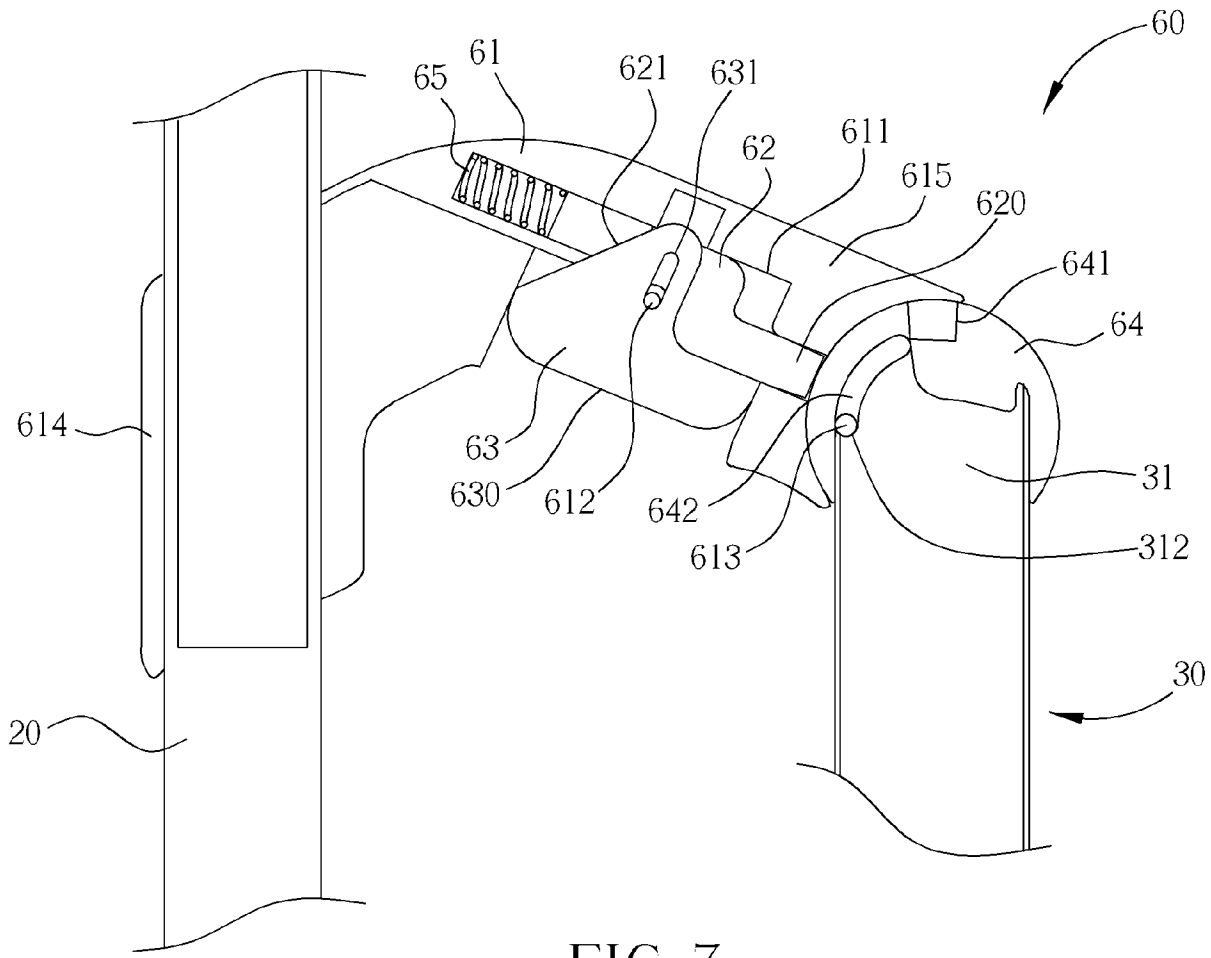
FIG. 7 is a diagram of a rear leg frame pivoted to the folding position relative to a front leg frame according to the first embodiment of the present invention.

Please refer to FIG. 6 and FIG. 7. FIG. 6 is a diagram of the folding device 60 in the unlocked position according to the first embodiment of the present invention. FIG. 7 is a diagram of the rear leg frame 30 pivoted to the folding position relative to the front leg frame 20 according to the first embodiment of the present invention. In order to fold the frame body 40 to a smaller size, the folding device 60 is unlocked by pressing the pressing portion 630 of the driving member 63 so that the driving member 63 moves to the folding body 61 along direction N1. At this time, the first inclined surface 632 of the driving member 63 has interaction with the second inclined surface 621 of the engaging member 62 and moves the engaging member 62 sliding in the sliding slot 611 along direction F2, so that the engaging section 620 of the engaging member 62 retracts from the slot 641 of the spindle 64 and the whole engaging member 62 moves back into the sliding slot 611 of the folding body 61. Then, the engaging member 62 is in the unlocked position shown in FIG. 6. The two lateral walls of the slot 641 of the spindle 64 are not abutted by the engaging member 62, and the spindle 64 and the rear leg frame 30 can be pivoted to the folding position shown in FIG. 7 relative to the folding body 61 (and the front leg frame 20) for folding the frame body 40.

When the engaging member 62 is in the unlocked position shown in FIG. 6, the elastic element 65 connected between the engaging member 62 and the folding body 61 is compressed. When the rear leg frame 30 is pivoted from the folding position shown in FIG. 7 to the opened position shown in FIG. 6 relative to the front leg frame 20, the elastic stress of the elastic element 65 pushes the engaging section 620 of the engaging member 62 along direction F1, from the sliding slot 611 of the folding body 61 to the slot 641 of the spindle 64, so as to restrain the frame body 40 in the opened position.

Figure 8:
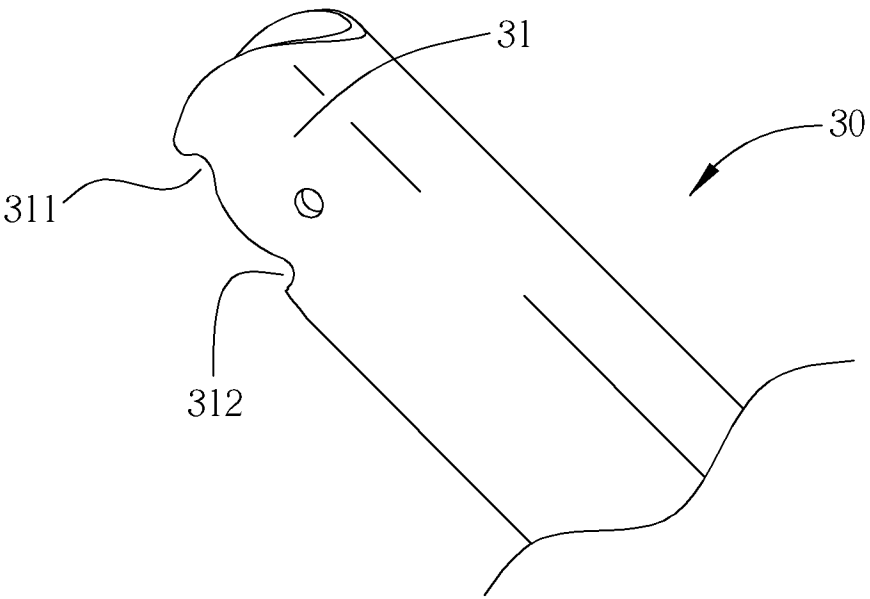
FIG. 8 is a diagram of a pivoting section of the rear leg frame according to the first embodiment of the present invention.

As shown in FIG. 4, FIG. 5, and FIG. 7, a long slot 642 is configured on a lateral side of the spindle 64. When the front leg frame 20 is pivoted relative to the rear leg frame 30, a limiting element 613 passing through a hole 616 of the second arm 615 and the long slot 642 of the spindle 64 of the folding body 61 moves in the long slot 642. In this embodiment, the limiting element 613 can be a rivet disposed on the folding body 61. Please refer to FIG. 8. FIG. 8 is a diagram of the pivoting section 31 of the rear leg frame 30 according to the first embodiment of the present invention. The pivoting section 31 of the rear leg frame 30 includes a first holder 311 and a second holder 312. When the frame body 40 is in the opened position shown in FIG. 4, the first holder 311 abuts on the limiting element 613 for preventing over-opening between the front leg frame 20 and the rear leg frame 30 caused by overloading of the seat 10. When the frame body 40 is in the folding position shown in FIG. 6, the second holder 312 abuts on the limiting element 613 for preventing over-rotation of the rear leg frame 30. The slot 641 of the spindle 64 can be hid by the folding body 61 so as to prevent an accident.

Figure 9:
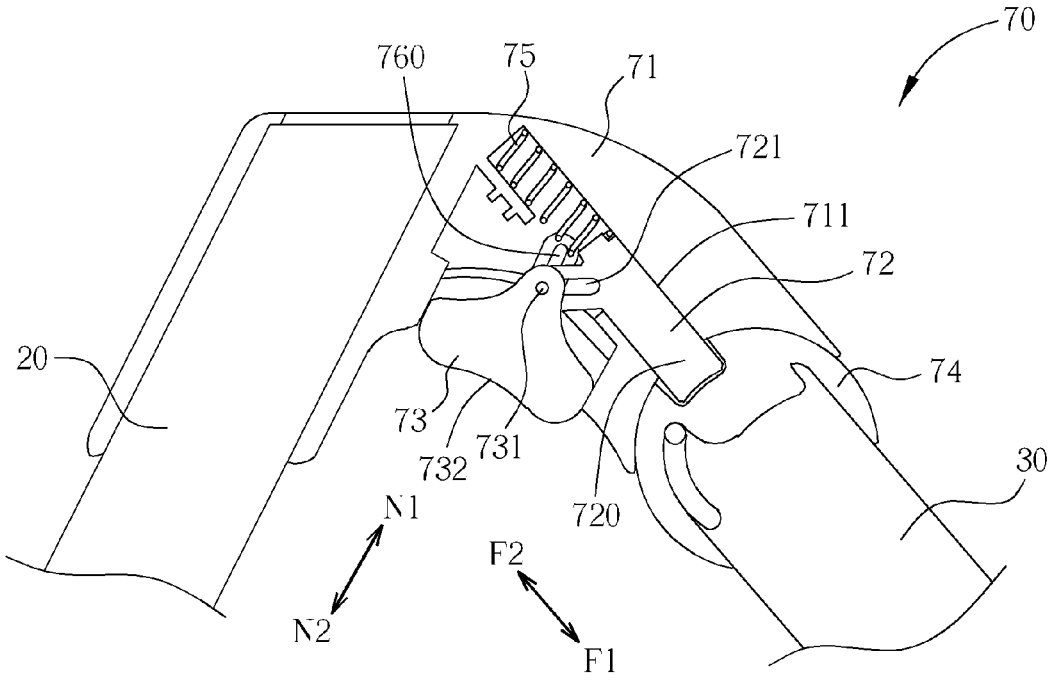
FIG. 9 is a diagram of a folding device according to a second embodiment of the present invention.
Figure 10:
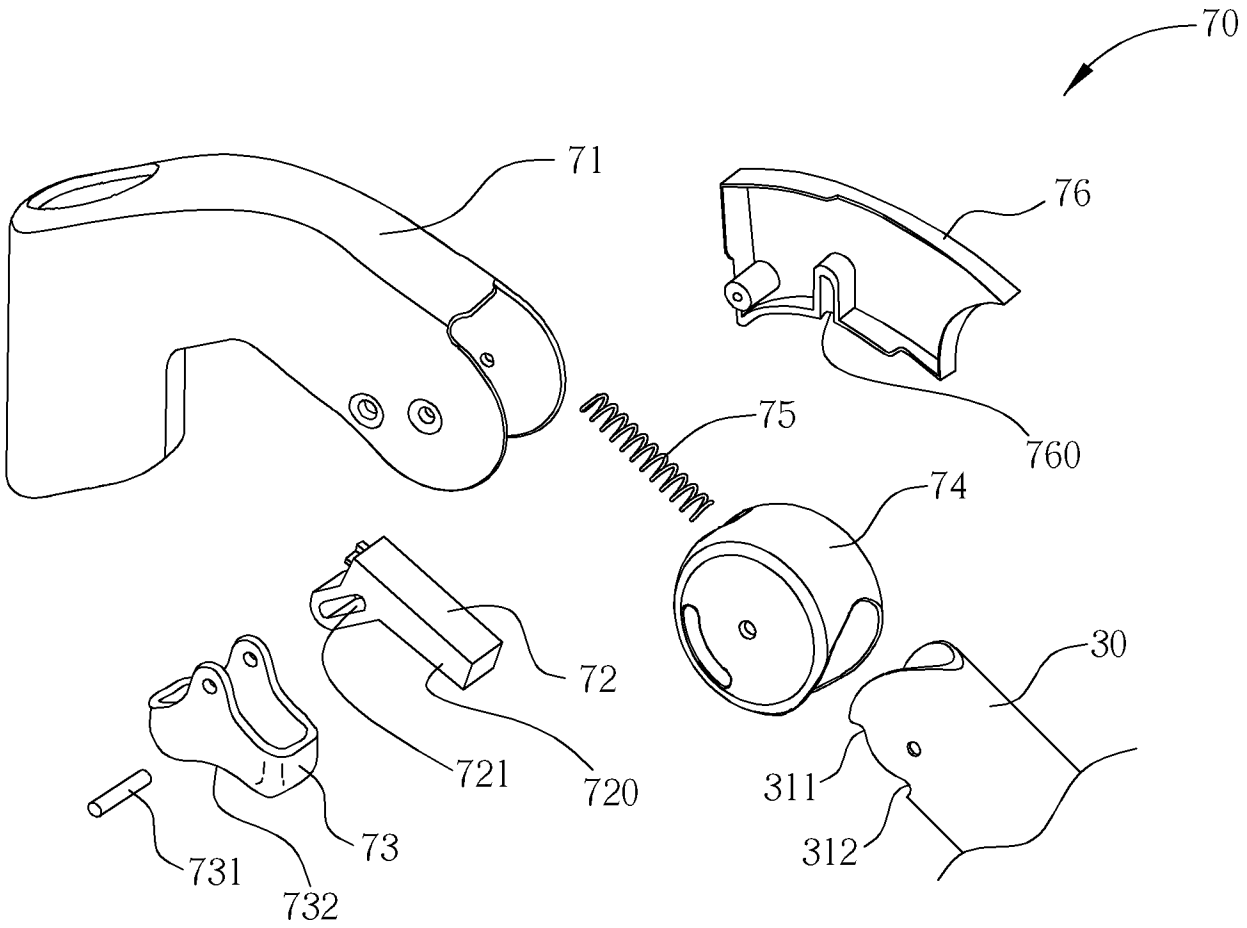
FIG. 10 is an exploded diagram of elements of the folding device according to the second embodiment of the present invention.

Please refer to FIG. 9 and FIG. 10. FIG. 9 is a diagram of a folding device 70 according to a second embodiment of the present invention. FIG. 10 is an exploded diagram of elements of the folding device 70 according to the second embodiment of the present invention. As shown in FIG. 9, when the folding device 70 is in the locked position, the rear leg frame 30 can not be pivoted relative to the front leg frame 20 so that the frame body 40 can be restrained in the opened position. The folding device 70 includes a folding body 71, an engaging member 72, a driving member 73, a spindle 74, and an elastic element 75.

The difference between the folding device 70 of the second embodiment and the folding device 60 of the first embodiment is the engaging member 72 and the driving member 73. The engaging member 72 includes an engaging section 720 and an inclined slot 721 located on an end opposite to the engaging section 720. The driving member 73 includes an axle 731 configured on a top end of the driving member 73 and a triangular pressing portion 732 in this embodiment. The axle 731 passes through the inclined slot 721 and engages with the inner slot of the folding body 71 and the sliding slot 760 of a cover 76 with its two ends so that the axle 731 can be movably configured on the folding body 71. The axle 731 can be moved in the inclined slot 721. When the driving member 73 is moved along directions N1 or N2, the axle 731 can be moved in the inclined slot 721 for driving the engaging member 72 to move along directions F1 or F2 in the sliding slot 711. In this embodiment, direction F1-F2 and direction N1-N2 are not parallel but with an angle.

Figure 11:
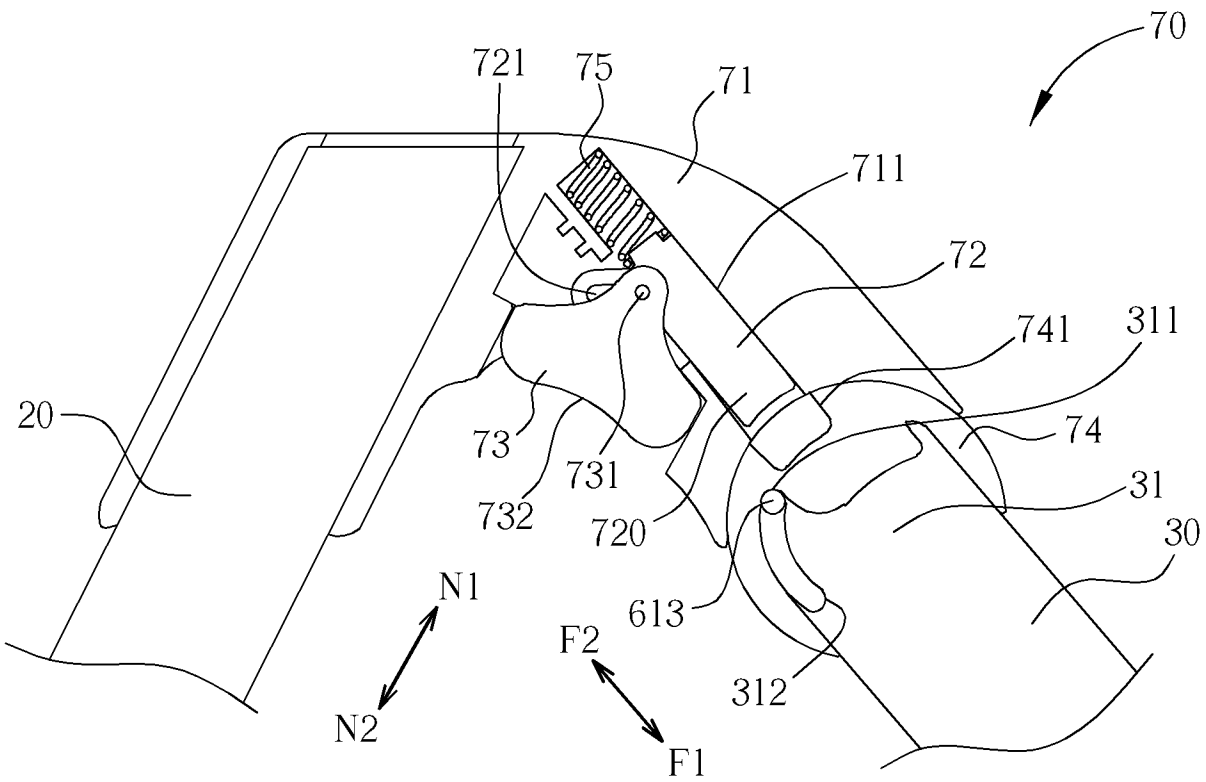
FIG. 11 is a diagram of the folding device in the unlocked position according to the second embodiment of the present invention.
Figure 12:
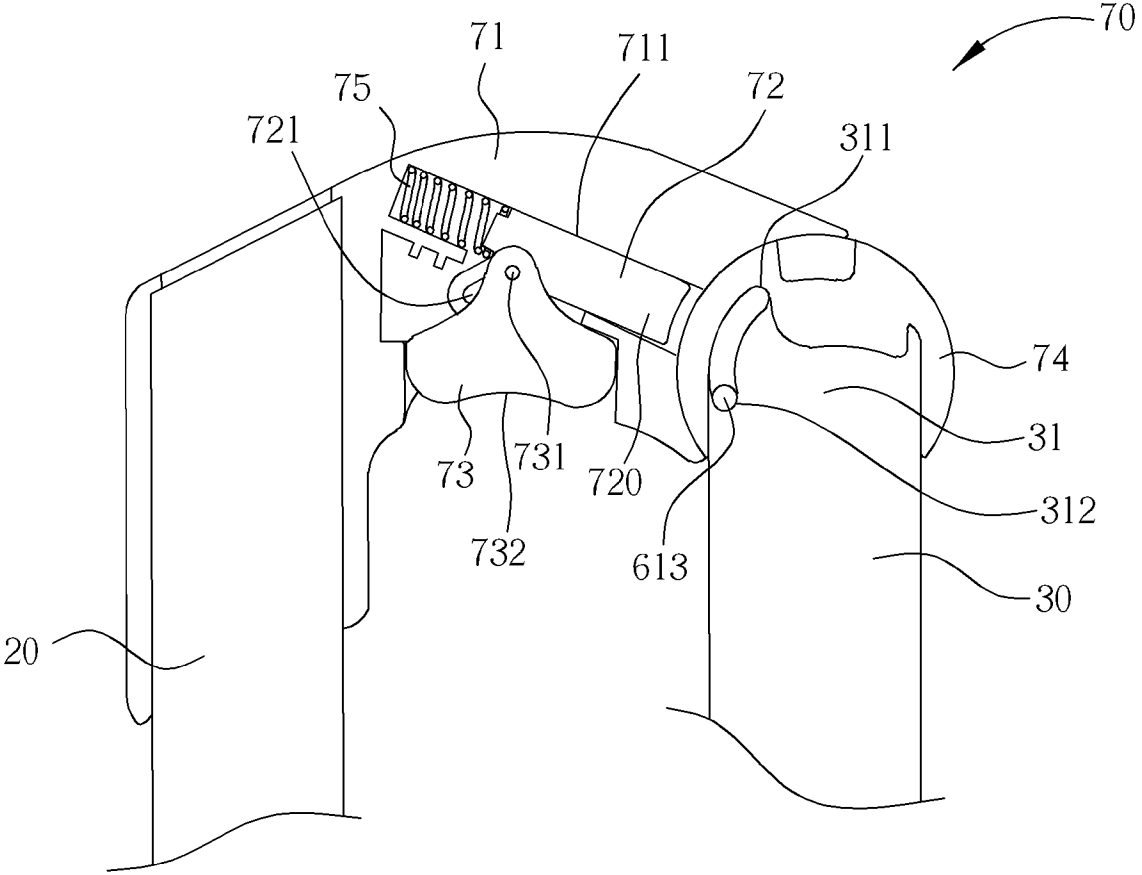
FIG. 12 is a diagram of the rear leg frame pivoted to the folding position relative to the front leg frame according to the second embodiment of the present invention.

Please refer to FIG. 11 and FIG. 12. FIG. 11 is a diagram of the folding device 70 in the unlocked position according to the second embodiment of the present invention. FIG. 12 is a diagram of the rear leg frame 30 pivoted to the folding position relative to the front leg frame 20 according to the second embodiment of the present invention. In order to fold the frame body 40 to a smaller size, the driving member 73 is pressed to move to the folding body 71 along direction N1. At this time, the axle 731 of the driving member 73 can be moved in the inclined slot 721 so as to drive the engaging member 72 moving in the sliding slot 711 along direction F2, retracting the engaging section 720 of the engaging member 72 out of a slot 741 of the spindle 74, and retracting the whole engaging member 72 out of the sliding slot 711 of the folding body 71. Then, the engaging member 72 is in the unlocked position shown in FIG. 11, and the spindle 74 and the rear leg frame 30 can be pivoted to the folding position shown in FIG. 12 relative to the folding body 71 (and the front leg frame 20) so that the frame body 40 can be folded. In addition, other working mechanism of the folding device 70 according to the second embodiment is substantially the same as the folding device 60 according to the first embodiment. The pivoting section 31 of the rear leg frame 30 also includes a first holder 311 and a second holder 312 so as to abut on the limiting element 613 when the frame body 40 is in the opened position and in the folding position, and detailed description is omitted herein for simplicity.

Figure 13:
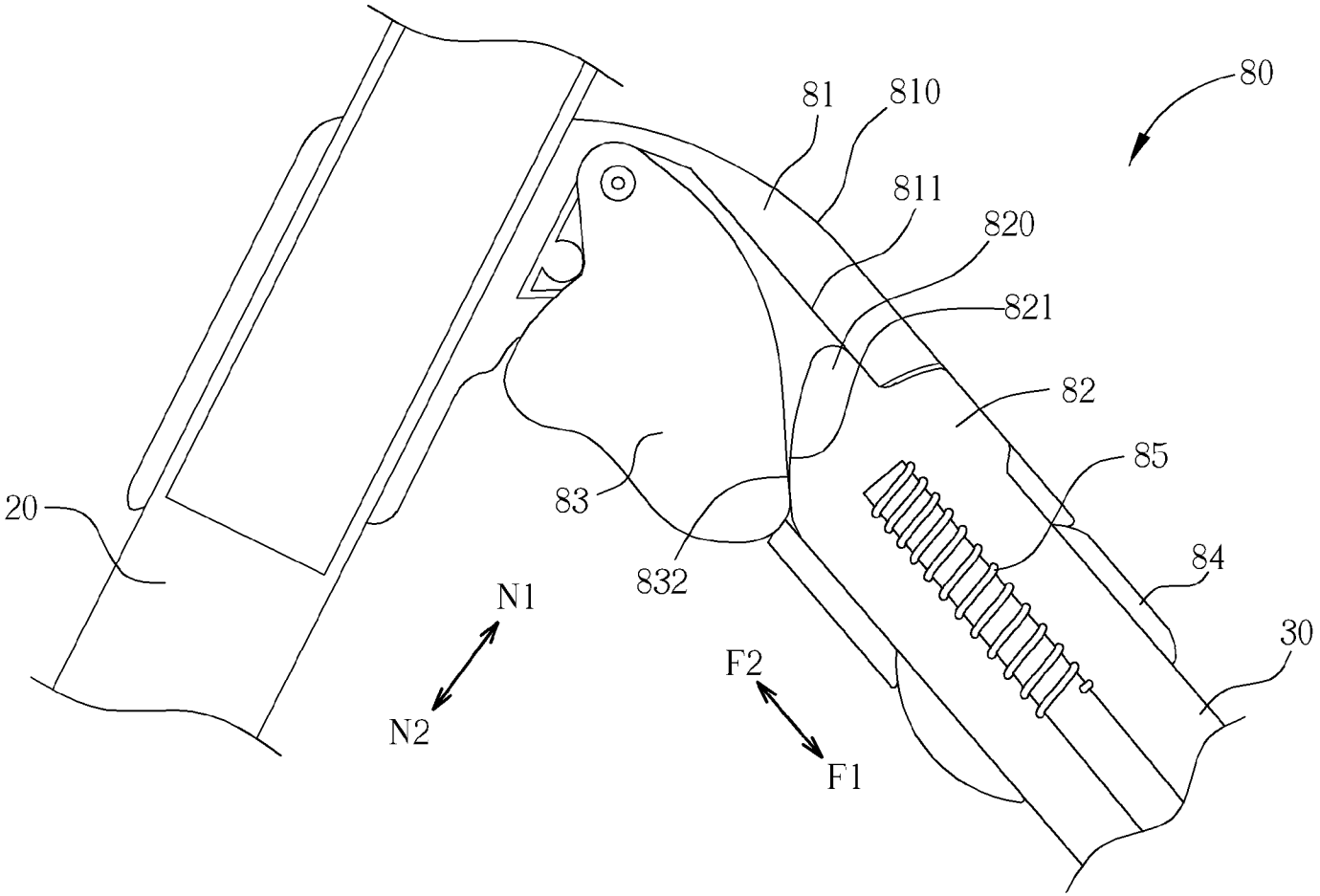
FIG. 13 is a diagram of a folding device according to a third embodiment of the present invention.
Figure 14:
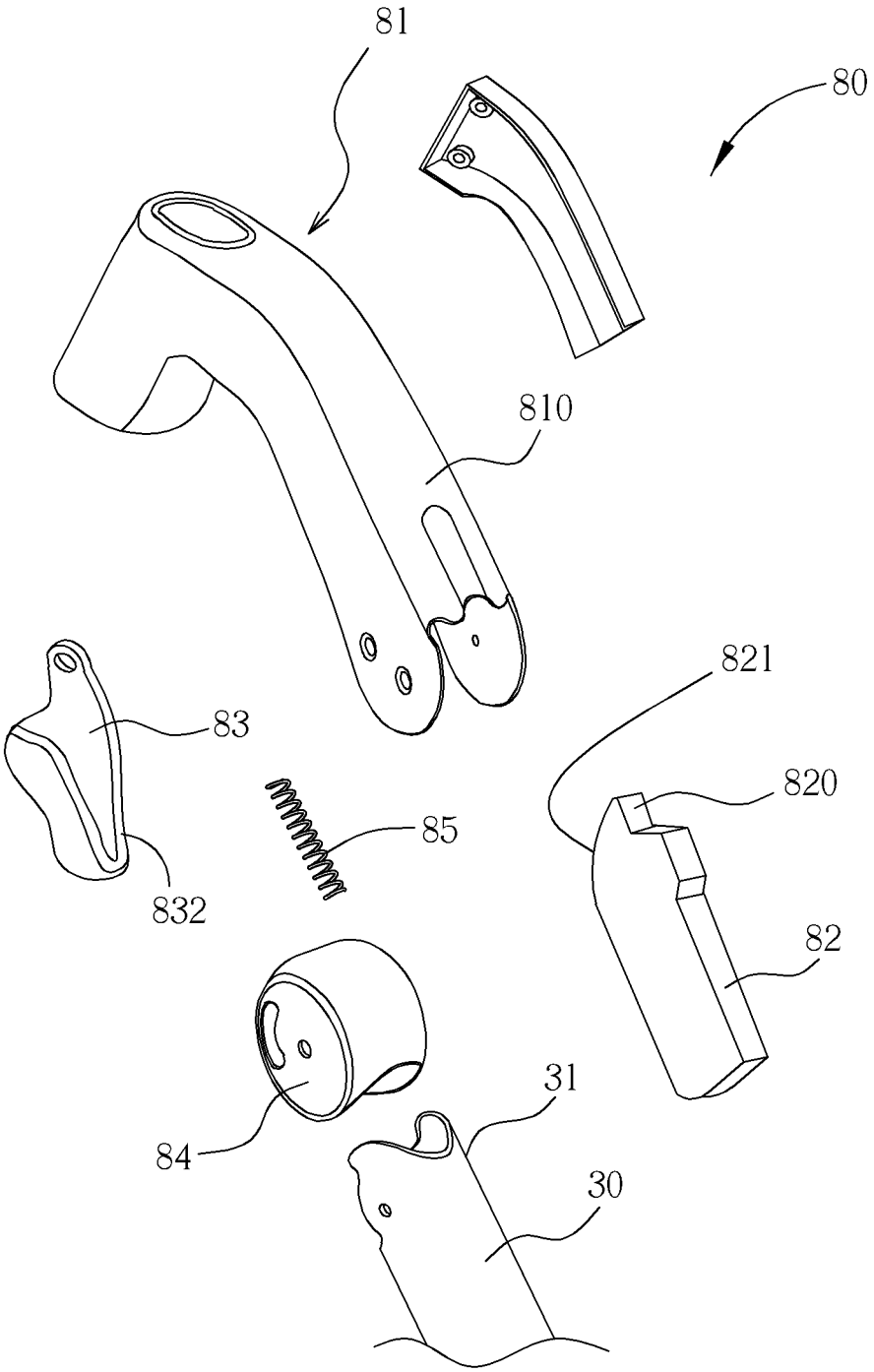
FIG. 14 is an exploded diagram of elements of the folding device according to the third embodiment of the present invention.

Please refer to FIG. 13 and FIG. 14. FIG. 13 is a diagram of a folding device 80 according to a third embodiment of the present invention. FIG. 14 is an exploded diagram of elements of the folding device 80 according to the third embodiment of the present invention. As shown in FIG. 13, when the folding device 80 is in the locked position, the rear leg frame 30 can not be pivoted relative to the front leg frame 20 so that the frame body 40 can be restrained in the opened position. The folding device 80 includes a folding body 81, an engaging member 82, a driving member 83, a spindle 84, and an elastic element 85.

As shown in FIG. 13, the folding body 81 is mounted on an end of the front leg frame 20, and the spindle 84 is not only connected to the pivoting section 31 of the rear leg frame 30 but also pivotally connected to a second arm 810 of the folding body 81. Therefore, the spindle 84 and the rear leg frame 30 can be pivoted relative to the folding body 81 (and the front leg frame 20 where the folding body 81 is located). The engaging member 82 connects to the spindle 84 slidably and extends out of the spindle 84 and the pivoting section 31 of the rear leg frame 30 movably. The folding body 81 includes a slot 811. In this embodiment, an end of the engaging member 82 includes an engaging section 820 engaged with the slot 811 that can be moved between the locked position shown in FIG. 13 and the unlocked position shown in FIG. 15 along directions F1 or F2. The engaging section 820 includes a second inclined surface 821. The elastic element 85 can be a spring. In this embodiment, the elastic element 85 is configured between the pivoting section 31 of the rear leg frame 30 and the engaging member 82. When the engaging member 82 moves along direction F1, the elastic element 85 can be compressed and bears elastic stress. The driving member 83 can be a button. In this embodiment, the driving member 83 pivotally connected to the second arm 810 of the folding body 81 includes a first inclined surface 832 on an end opposite to the pivot so as to correspond to the second inclined surface 821 of the engaging member 82. The driving member 83 can be configured on the folding body 81 in a manner of pivoting along directions N1 or N2 relative to the folding body 81.

As shown in FIG. 13, when the engaging member 82 of the folding device 80 is in the locked position, the engaging section 820 of the engaging member 82 extends in the slot 811 of the folding body 81. At this time, the engaging member 82 abuts on a lateral side of the slot 811, and the first inclined surface 832 of the driving member 83 abuts on the second inclined surface 821 of the engaging section 820 of the engaging member 82. Therefore, the spindle 84 and the rear leg frame 30 can not be pivoted relative to the folding body 81 and the front leg frame 20 so that the frame body 40 can be restrained in the opened position.

Figure 15:
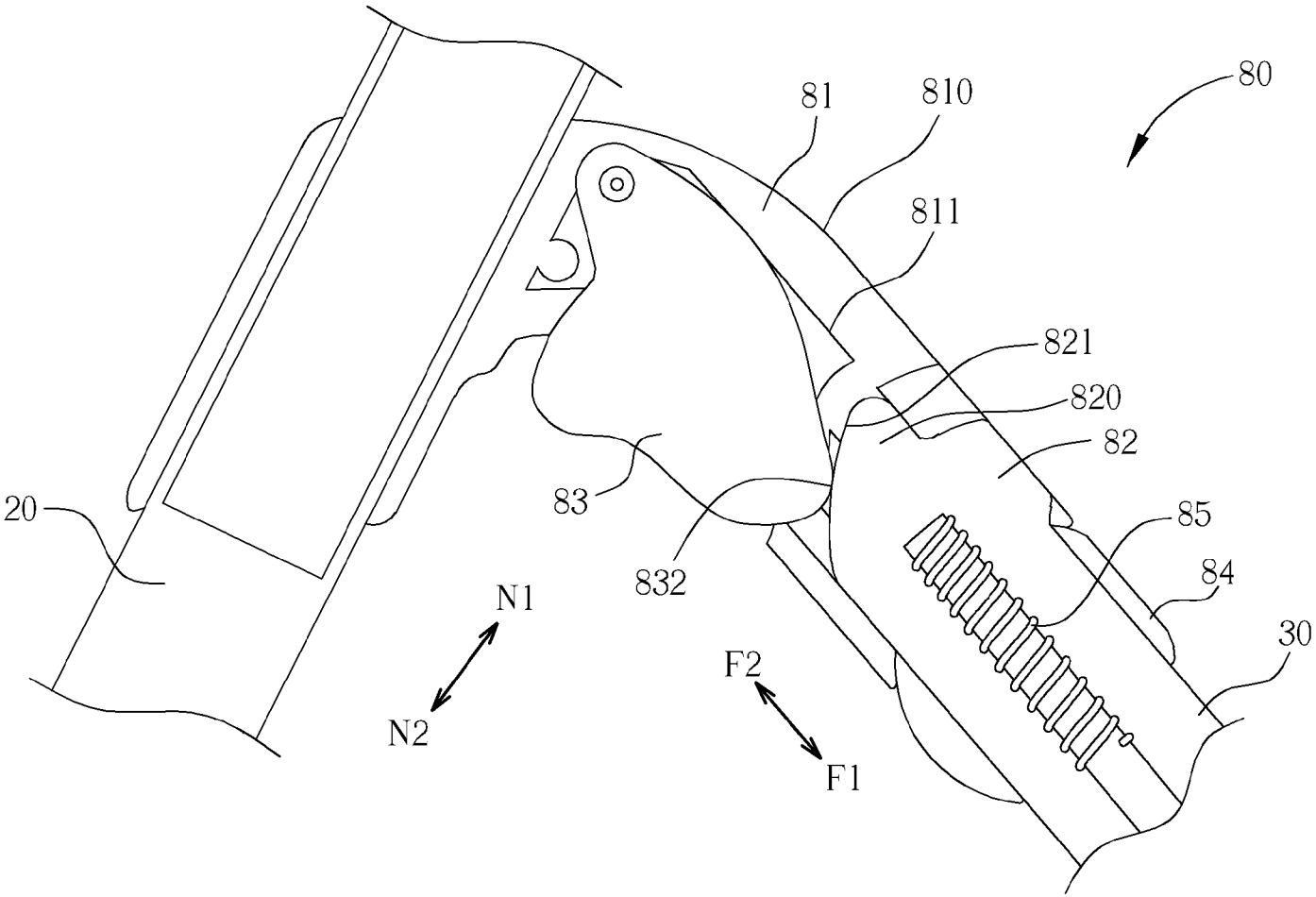
FIG. 15 is a diagram of the folding device in the unlocked position according to the third embodiment of the present invention.
Figure 16:
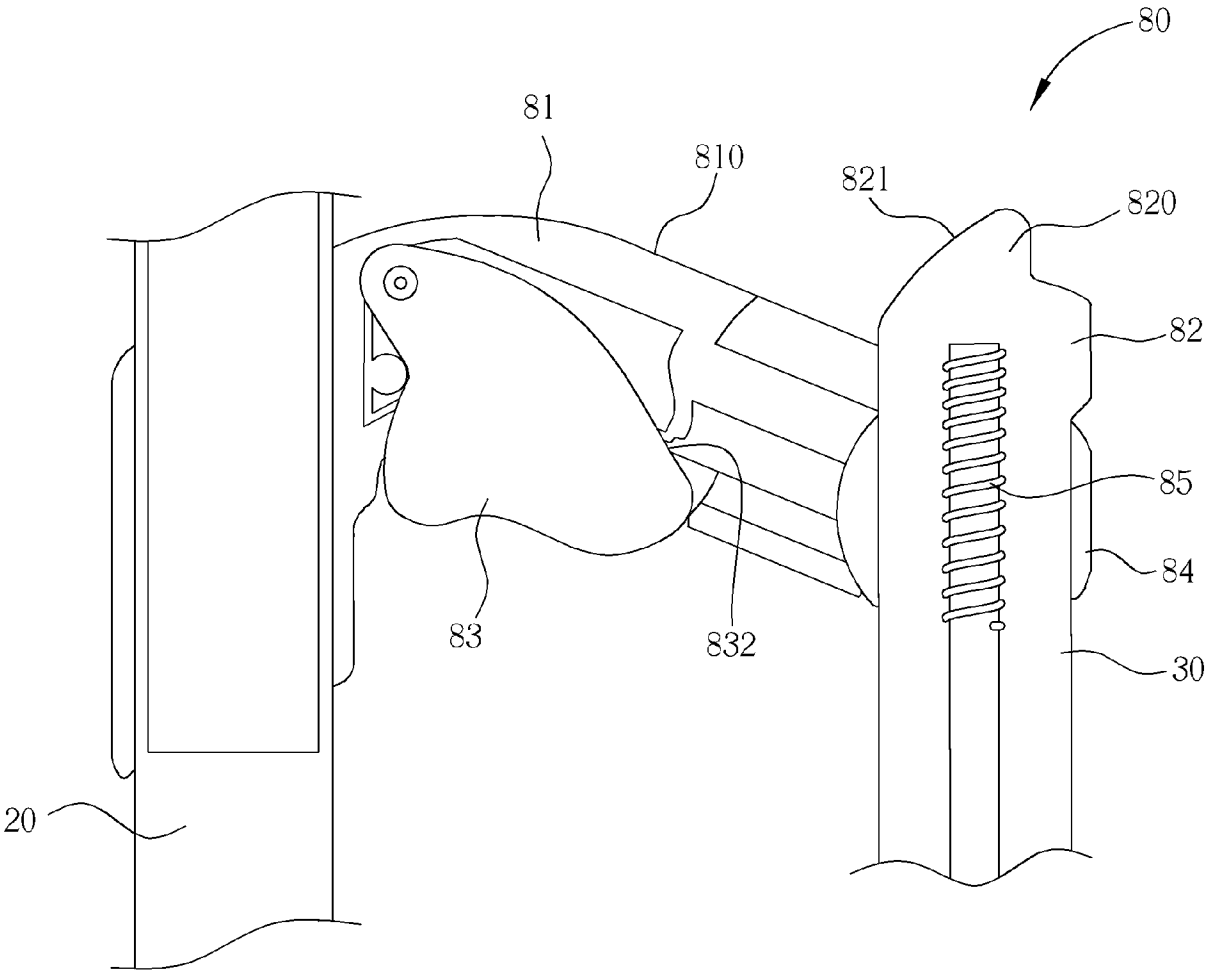
FIG. 16 is a diagram of the rear leg frame pivoted to the folding device relative to the front leg frame according to the third embodiment of the present invention.

Please refer to FIG. 15 and FIG. 16. FIG. 15 is a diagram of the folding device 80 in the unlocked position according to the third embodiment of the present invention. FIG. 16 is a diagram of the rear leg frame 30 pivoted to the folding position relative to the front leg frame 20 according to the third embodiment of the present invention. In order to fold the frame body 40 to a smaller size, the folding device 80 is unlocked by pressing the driving member 83 to rotate to the folding body 81 correspondingly along direction N1. At this time, the first inclined surface 832 of the driving member 83 has interaction with the second inclined surface 821 of the engaging member 82, and moves the engaging member 82 sliding along direction F1 so as to retract the engaging member 82 out of the slot 811 of the folding body 81. When the engaging member 82 is in the unlocked position shown in FIG. 15, the spindle 84 and the rear leg frame 30 can be pivoted to the folding position shown in FIG. 16 relative to the folding body 81 (and the front leg frame 20) so that the frame body 40 can be folded.

When the rear leg frame 30 is pivoted from the folding position shown in FIG. 16 to the opened position shown in FIG. 15 relative to the front leg frame 20, the elastic element 85 connected between the engaging member 82 and the rear leg frame 30 is compressed, and the elastic stress of the elastics element 85 pushed the engaging member 82 to extend in the slot 811 of the folding body 81 so as to restrain the frame body 40 in the opened position again.

The high chair configures the folding device at the pivot between the rear leg frame and the front leg frame so that operation from a user is easy by pressing the driving member. When the driving member is pressed, the driving member moves the engaging member to the unlocked position relative to the folding body, so that the rear leg frame disengages from and pivots on the front leg frame. The high chair can then be folded easily for the user, and the structure of the present invention is simpler than the prior art.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A high chair comprising:

a seat; and a frame body for supporting the seat and capable of moving between an opened position and a folding position, the frame body comprising:

a front leg frame and a rear leg frame pivotally connected to each other, the front leg frame comprising a lower front leg and an upper front leg, and the seat being installed on the upper front leg only, a bottom of the lower front leg and a bottom of the rear leg frame each making contact with a floor surface upon which the high chair rests when the frame body is in the opened position, the bottom of the lower front leg and the bottom of the rear leg frame forming a gap therebetween, the gap being larger when the frame body is in the opened position than when the frame body is in the folding position;

a folding body mounted on the front leg frame between longitudinal ends of the front leg frame and the folding body having an arm extending at an oblique angle relative to the front leg frame, the arm being pivotally connected to a pivoting section of the rear leg frame, wherein the upper front leg is longitudinally slidably mounted on the lower front leg at a location of the front leg frame where the arm extends from the front leg frame; and an engaging member movably configured on one of a distal end of the arm of the folding body with respect to the front leg frame and the pivoting section of the rear leg frame and engaged with the other one of the distal end of the arm of the folding body and the pivoting section of the rear leg frame so as to restrain the frame body in the opened position.

2. The high chair of claim 1, wherein a driving member is movably configured on the arm of the folding body, for disengaging the engaging member from the other one of the arm of the folding body and the pivoting section of the rear leg frame.

3. The high chair of claim 1, wherein the pivoting section of the rear leg frame is pivotally connected to the arm of the folding body at a location on the pivoting section that is spaced from the engaging member.

4. The high chair of claim 1, wherein the pivoting section of the rear leg frame is pivotally connected to the arm of the folding body via a spindle on the rear leg frame.

5. The high chair of claim 4, wherein the arm of the folding body has extending portions, the spindle is hid between extending portions.

6. The high chair of claim 1, wherein the folding body is mounted on the lower front leg.

7. The high chair of claim 4, wherein the spindle comprises a slot, and the engaging member is movably configured on the folding body and engaged with the slot so as to restrain the rear leg frame in the opened position.

8. The high chair of claim 1, wherein the folding body comprises a limiting element, and the pivoting section of the rear leg frame comprises a first holder for abutting the limiting element for preventing over-opening between the front leg frame and the rear leg frame.

9. The high chair of claim 1, wherein the folding body comprises a limiting element, and the pivoting section of the rear leg frame comprises a second holder for abutting the limiting element for preventing over-rotation of the rear leg frame.

10. The high chair of claim 4, wherein the spindle comprises a long slot, the folding body comprises a limiting element movable in the long slot, and the pivoting section of the rear leg frame comprises a first holder and a second holder, the first holder abuts the limiting element when the rear leg frame is in the opened position and the second holder abuts the limiting element when the rear leg frame is in the folding position.

11. The high chair of claim 1, wherein the high chair further comprises an elastic element connected between the engaging member and one of the folding body and the pivoting section of the rear leg frame.

12. The high chair of claim 2, wherein the driving member is a button moveable along a first direction relative to the folding body so as to move the engaging member.

13. The high chair of claim 12, wherein the first direction forms an angle with a moving direction of the engaging member.

14. A high chair comprising:

a seat;

a frame body for loading the seat and comprising a front leg frame and a top end of a rear leg frame pivotally connected to a middle of the front leg frame, a bottom of the front leg frame and a bottom of the rear leg frame each making contact with a floor surface upon which the high chair rests when the frame body is in an opened position, wherein the front leg frame comprises a lower front leg and an upper front leg, and the seat is installed on the upper front leg only;

a folding body including a first arm and a second arm connected to the first arm with an angle relative to the first arm, the first arm being mounted on the middle of the front leg frame and the second arm being pivotally connected to a spindle of the rear leg frame, wherein the upper front leg is longitudinally slidably mounted on the lower front leg at a location of the front leg frame where the first arm extends from the front leg frame; and an engaging member movably configured on one of the folding body and the spindle moved between a locked position and an unlocked position so as to engage and disengage with the other one of the folding body and the spindle;

wherein when the engaging member is in the unlocked position, the rear leg frame moves toward the front leg frame and a distance between the bottom of the front leg frame and the bottom of the rear leg frame changes at the same time until the rear leg frame is in a folding position, and when the rear leg frame is in the folding position the bottom of the front leg frame and the bottom of the rear leg frame both rest on the floor surface, the bottom of the front leg frame and the bottom of the rear leg frame forming a gap therebetween, the gap being larger when the frame body is in the opened position than when the frame body is in the folding position.

15. The high chair of claim 14, wherein the folding body comprises a limiting element, and a pivoting section of the rear leg frame comprises a first holder for abutting the limiting element for preventing over-opening between the front leg frame and the rear leg frame.

16. The high chair of claim 14, wherein the folding body comprises a limiting element, and a pivoting section of the rear leg frame comprises a second holder for abutting the limiting element for preventing over-rotation of the rear leg frame.

17. The high chair of claim 14, wherein the folding body is mounted on a top end of the lower front leg.

* * * * *